United States Patent [19]

Reimer et al.

[11] Patent Number: 4,863,388

[45] Date of Patent: Sep. 5, 1989

[54] ROTATING CONTACT ZIF CONNECTOR

[75] Inventors: William A. Reimer, Wheaton; David L. Vonder, Addison, both of Ill.

[73] Assignee: AG Communication Systems Corporation, Phoenix, Ariz.

[21] Appl. No.: 190,190

[22] Filed: May 4, 1988

[51] Int. Cl.[4] ..... H01R 9/09; H01R 13/28; H01R 35/04

[52] U.S. Cl. ..... 439/31; 439/288; 439/291; 439/341; 439/261

[58] Field of Search ..... 439/326–328, 439/341, 342, 259, 261, 31, 1, 288, 290, 291

[56] References Cited

U.S. PATENT DOCUMENTS

| | | | |
|---|---|---|---|
| 3,199,059 | 8/1965 | Masse et al. | 439/31 |
| 3,268,849 | 8/1966 | Silverberg | 439/629 |
| 3,601,746 | 8/1971 | Teagno | 439/31 |
| 3,701,071 | 10/1972 | Landman | 439/329 X |
| 4,273,401 | 6/1981 | Katzin | 439/286 |
| 4,632,475 | 12/1986 | Tomita | 439/1 |
| 4,657,320 | 4/1987 | Bamford et al. | 439/31 |
| 4,701,133 | 10/1987 | Worth | 439/288 X |
| 4,715,819 | 12/1987 | Iwasa et al. | 439/31 |

*Primary Examiner*—Steven C. Bishop

*Attorney, Agent, or Firm*—Robert J. Black; Gregory G. Hendricks

[57] ABSTRACT

A two-piece rotating contact zero insertion force connector is used to interconnect printed circuit boards (daughter boards) to backplanes (mother boards), cables to panels or cables to cables. This is accomplished by rotating one-half of the mating contacts relative to the other half to complete the necessary electrical connection. A number of different rotating contact designs are included which could be utilized to implement the overall concept.

7 Claims, 4 Drawing Sheets

ROTATING CONTACT ZIF CONNECTOR

BACKGROUND OF THE INVENTION

1. Field of the Invention

The present invention relates to printed wiring board connectors and more particularly to a connector arrangement that utilizes rotating contacts of unique design to provide a zero insertion force type of connector.

2. Background Information

Zero insertion force connectors have been available in the marketplace for well over a decade. Their acceptance by the user community has been sparse and slow largely due to the relative high cost per contact compared to conventional printed circuit board connectors.

Conventional zero insertion force connectors consist of a molded plastic body equipped with two rows of contacts located along both sides of a narrow slot into which a printed circuit board is inserted. At this point no electrical contact is made between the connector contacts and the printed circuit board. Typically, a lever-actuated cam internal to the connector body prevents the contact engagement from occurring. When the lever is then actuated the cam surfaces cause the connector contacts to translate and make electrical contacts with the printed circuit board tabs. This procedure is reversed prior to removing the printed circuit board from the zero insertion force connector.

Connector blocks of this type have been disclosed in U.S. Pat. No. 3,526,869, a connector disclosed therein also requires a large number of parts and is expensive to manufacture in terms of the cost, parts and labor to assemble the parts. Further, of course, as with any zero insertion force connector arrangement such as this, after the daughter board has been inserted it then becomes necessary as a separate step to actuate the cam means to form the electrical connections. Frequently the electrical connections achieved by the conventional zero force type connector do not include the wiping action between the terminal and circuit board pad so that it is possible that there may be an undesirably high contact resistance developed between the terminal and the daughter board. Contact wiping action has long been recognized as a good method of breaking through oxides and other insulating films that occur on contact interfaces. It is also well known that a contact wiping action will also push particulant matter, which can cause electrical opens, away from the point of electrical contact.

Thus, it is obvious from the foregoing that contact wiping action will tend to promote low and stable contact resistance. Another disadvantage to current zero insertion force connectors is their means of actuation. This actuation mechanism is generally located at one end of the connector body where actuation has occurred by rotating a lever through a 90 degree angle or applying a push pull force to a straight rod. In many card files, as utilized in telephone central office switching systems and in some computers, the connectors are located in the backplane at the back of the file and cannot be accessed from the front to perform the necessary zero insertion force actuation sequence. Since cards are inserted and extracted from the front of the card file, the use of zero insertion force connectors at the back of the file is very cumbersome at best. This "volumetric" approach to packaging of printed circuit boards and backplanes however has found wide usage throughout the electronic industry.

A "planar" approach to printed circuit board packaging is being explored and pursued by some manufacturers. Instead of mounting the printed circuit boards perpendicular to the backplane, they are mounted parallel to it. Such an arrangement is also suggested in U.S. Pat. No. 3,701,071 and U.S. Pat. No. 4,273,401. In the present application, the particular implementation proposed is substantially different than that taught in the prior art.

SUMMARY OF THE INVENTION

In the present invention planar mounted daughter boards are employed. That is to say that both mother and daughter boards in ultimate position or usage lie in parallel planes. While such an arrangement has obvious advantages in terms of packaging, it has been found to be somewhat difficult to connecterize. Accordingly, the two piece zero insertion force connector described in the present application has been designed particularly for use with planar mounted printed circuit boards. The particular construction of the printed circuit board is not necessarily part of the present invention and they may be manufactured of any typical material now in use, such as ceramic, glass reinforced epoxy or of insulated metal core construction. In the arrangement taught in the present invention, one half of the two piece zero insertion force connector is mounted on the mother board and the other half mounted on the daughter board. Initially, the two halves are mated with the daughter board being placed perpendicular to the mother board. This card orientation, during the mating operation, simplifies the printed circuit board mounting. Due to the design of the contacts employed, the initial engagement force is zero. After this the daughter board and its connector half is rotated through an angle to a position parallel to the mother board. The pivot point is established by pivot pins and pivot slots located on the ends of both connector halves. It is during this rotation that the contact forces and contact wiping action is generated. A number of different contact designs have been employed for use in the present invention that satisfy the requirements of rotation through an angle for actuation. It should be pointed out, however, that the angle of rotation is not necessarily critical in all designs and might have a tolerance as high as 90 degrees plus or minus 45 degrees.

Inasmuch as the rotation is not critical, another degree of freedom is afforded to the engineer when working in the planar mode. That is, full rotation through an angle of 90 degrees would occupy a particular amount of space on the associated mother board. However, it is also possible to only rotate the card 45 degrees and latch it in this position, therefore the space required on the associated mother board would be less than three quarters of that of a fully rotated card. While in this arrangement the component height off of the mother board would be increased, space below the card could be used to mount other components. It is also possible by virtue of the teachings of the present invention to place circuit board components on the underneath side of the daughter board rather than on the top side of the daughter board by merely extending the mounting portions of the associated plastic housing of the connector.

In referring to the contacts in the preferred design, a similar contact is used in both halves of the connector, each includes an embossed section which causes a depression on one side of the contact and a raised portion on the other. During zero force engagement, the raised side of the emboss of one contact is nested in the recessed side of the emboss on the other. Thus, when the contacts are rotated at 90 degrees to each other, the embossed portions interfere with each other and the resulting interferences causes the contacts being forced apart. It is this force that generates the contact force to create a reliable two point electrical connection as well as a desirable wiping action.

DESCRIPTION OF THE PREFERRED EMBODIMENT

Figure 1:
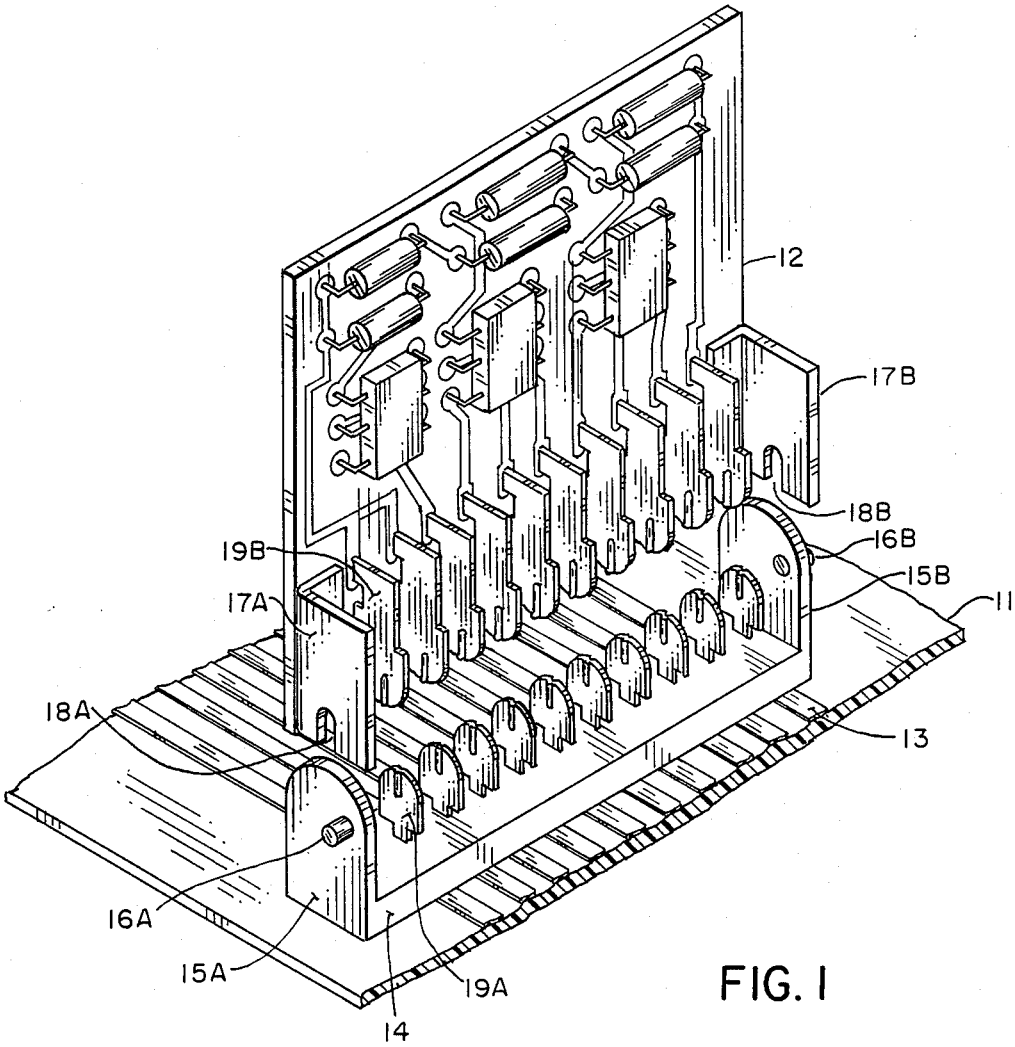
FIG. 1 is a perspective view of a zero insertion force connector arrangement as taught by the present invention showing the mother and daughter board in location prior to their engagement.
Figure 2:
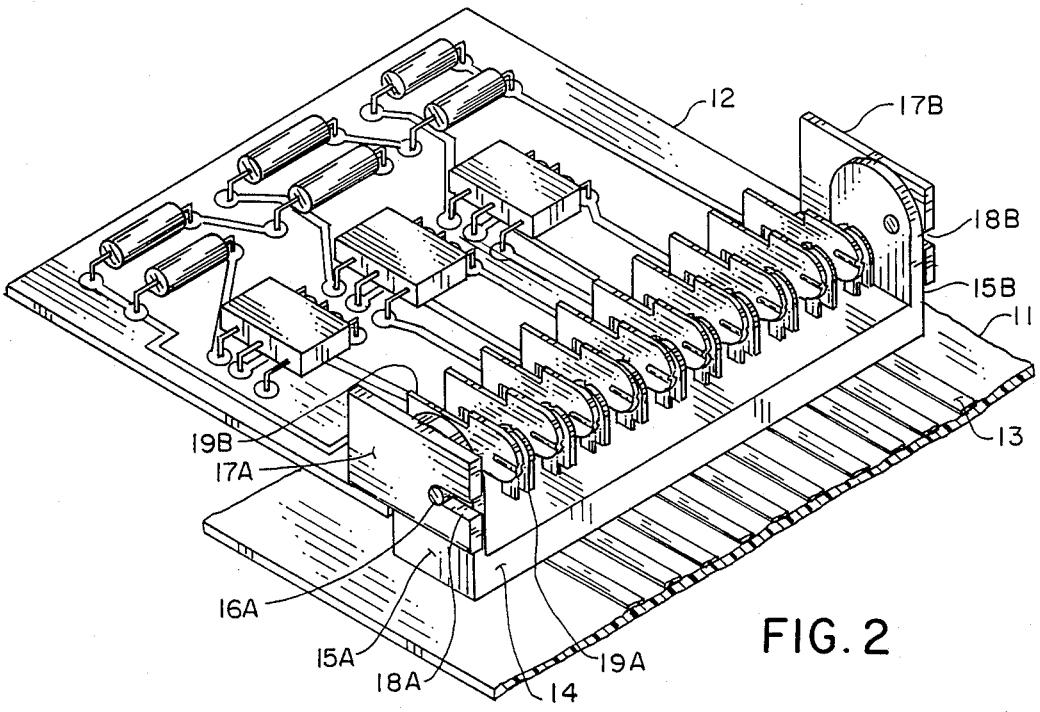
FIG. 2 is a prospective view of a connector arrangement in accordance with the present invention showing the mother and daughter board after engagement and rotation through 90 degrees to establish connection between the contacts.
Figure 3A:
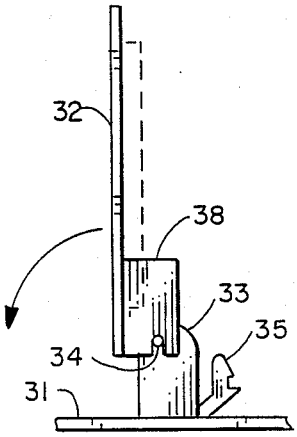
FIGS. 3A and 3B show a side view of the connector arrangement in accordance with the present invention in both the initial and engaged positions with the components on the printed circuit board mounted on the top of the printed circuit board.
Figure 3B:
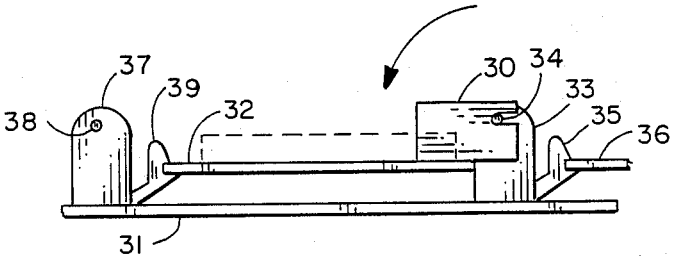

Referring now to FIG. 1, a two piece zero insertion force connector in accordance with the present invention is shown in perspective form. As may be seen in FIG. 1, a mother board 11, having a plurality of circuit conductors such as 13 has a lower portion of the connector mounted thereon. The lower portion of the connector consists of a u-shaped plastic or other insulated material base unit 14, having upstanding earlike projections on either end thereof designated 15A and 15B located on each of the end projections and projecting portions are pivot pins 16A and 16B, respectively. Included in the base 14A are a plurality of contacts like 19A which pass through the base portion of lower connector section 14 and make electrical contact with the circuit connector conductors such as 13. Shown in an upright or vertical position prior to joining the upper and lower connector sections is daughter board 12 on which is mounted at either end thereof the other portion of the zero insertion force connector in accordance with the present invention consisting of circuit board supports 17A and 17B each including a pivot receiving slot such as 18A and 18B respectively. Also included are a plurality of circuit contacts such as 19B which are electrically connected to the components mounted on daughter board 12. Initially the two halves of the connector are mated with the daughter board 12 perpendicular to mother board 11. As may be seen from the drawing of FIG. 1, the embosses on contacts 19A and 19B directly engage with each other as the daughter board is brought down with the pivot slots 18A and 18B engaging the pivots 16A and 16B. Because of the design of the contacts, this initial engagement force is zero. The contacts are engaged and the pivots rest in the pivot slots, the daughter board is rotated 90 degrees to the location shown in FIG. 2. It is during this rotation that the contact forces and contact wiping action are generated. A further understanding may also be had by to reference to FIG. 3A and 3B wherein again the daughter board 32 is shown in the vertical position relative to the mother board 31, but with the pivot slots in the pivot pins and then as seen in FIG. 3B with the daughter board rotated 90 degrees to establish the connections. As may be seen in FIGS. 3A and 3B, a daughter board combined support and lock 35 as shown in FIG. 3A or 35 and 39 shown in FIG. 3B is included as a portion of the lower part of the connector. As can be readily seen in FIG. 3B the daughter board 32 once in the parallel or horizontal position relative to mother board 31 is supported and locked into position by support 39 and adjacent daughter board such as 36 would be supported and engaged by support 35, etc.

Figure 4A:
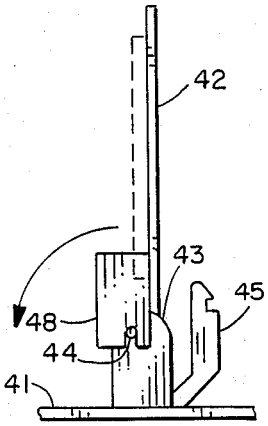
FIGS. 4A and 4B show an alternate form of the connector form of the present arrangement wherein the printed circuit board components are shown on the bottom of the printed circuit board.
Figure 4B:
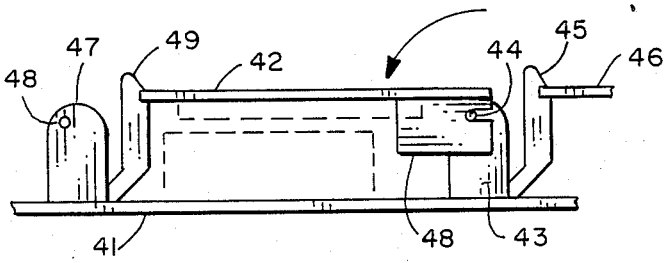

Because the angle of rotation is not critical, substantial freedom of design is afforded by means of the present arrangement when working in the planar mode. As may be readily seen if the support members such as 39 and 35 were made much taller, the connectors such as 33 and 37 (FIG. 3B) could be placed closer together and the card might be rotated something less than a full 90 degrees such as, for example, 45 degrees. In this case the projected area on the mother board occupied by the resultant assembly would be less than three quarters of the space occupied by a fully rotated card. In another arrangement, component height off the mother board could be increased and the space below the card could be used to mount other components. Such an arrangement is shown in FIGS. 4A and 4B whereby placing the connector half on the underside of the card as may be seen in FIG. 4B, the profile of components could be then mounted on the mother board underneath the daughter board.

As may be seen in FIGS. 3A, 3B, 4A and 4B, when an array of printed wiring boards are mounted on a mother board, the spring latch for one card may be part of the molded plastic housing of an adjacent connector. Such an arrangement clearly minimizes the amount of additional mounting hardware required.

Figure 5A:
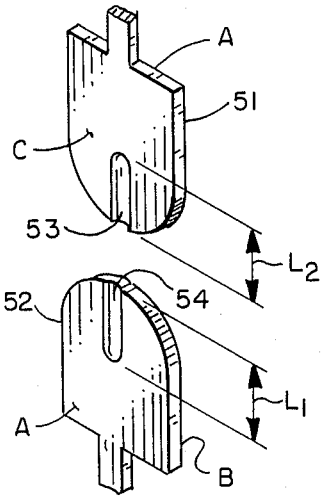
FIGS. 5A, 5B, 5C, 5D and 5E show various views of the preferred types of contacts utilized in the present invention.
Figure 5B:
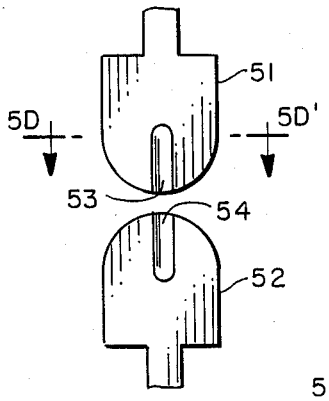

Referring now to FIG. 5A, shown in perspective form is an embossed blade contact, which may be considered a preferred design for use in the connector of the present invention. Both contacts 51 and 52 are identical as used in the two halves of the connector of the present invention. During zero force engagement, the raised side 54 of the emboss of one contact is nested in the recessed side 53 of the emboss on the other contact 51. The top view of both contacts prior to engagement is shown in FIG. 5D taken along lines 5D and 5D' shown in FIG. 5B, wherein it can be readily seen how contacts 51 and 52 have their raised and depressed portions of the embosses nesting in each other. Because of the design of the embosses, zero force engagement takes place.

Figure 5C:
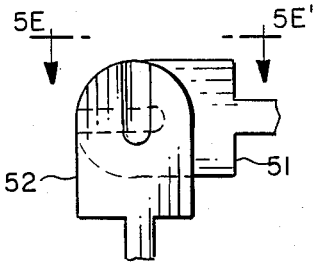
Figure 5D:
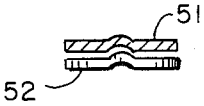
Figure 5E:
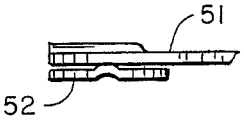

When the contacts are rotated 90 degrees to each other as shown in FIG. 5C, the embosses then interfere with each other and the resulting interference causes the contacts to be forced apart as can be seen in FIG. 5E, which is taken along section lines 5E and 5E prime of FIG. 5C. It is this force that generates the contact force to create a reliable two point electrical contact. Both contacts may be plated with a noble medal, such as gold, which is typical practice for electrical contacts of this nature.

In practice, these contacts would be arranged in their connector bodies with every other contact of emboss facing one way, with the remaining contacts facing in the opposite direction. By doing this, the contact forces generated during 90 degree rotation cancel each other out thereby eliminating any side thrust forces between mating connector halves. Pivot pins and locking pivot slots located at the ends of the connectors act as the pivot points during rotation and also prevent the connector halves from disengaging during and after rotation as may be seen again by referring to FIGS. 1 and 2.

Contact sequencing (make first, break last, etc.) can be accomplished by changing the relative sizes of the two embosses and selectively loading them in the connector body during manufacture. When the recess side of the emboss is wider than the raised emboss on the mating contact, the point at which electrical contact is established, occurs at a different angle during the rotation than when both embosses are the same size and width. Thus, by varying the relative sizes of the embosses, such as 53 and 54, as seen in FIG. 5A, it can be readily seen that normal make first and make last contact types can be created and employed within the same connector body. It should also be noted that since this contact system is hermaphroditic in nature, it is possible to double the useful life (that is the number of mating and unmating cycles) if initially the near sides of the contacts are mated and then they are repositioned within the connector so as to engage the far sides. This duality of electrical contact surfaces could be used to double the longevity of the connector system in accordance with the present invention when utilized in the field.

An additional feature of the present contact system is that rotation of the contact is not necessary to develop the contact forces to create a reliable connection. Straight translation along the axis of the emboss will also create contact. If the length L2 of the recessed emboss as seen in FIG. 5A is much smaller than the length L1 of the raised emboss, contact engagement will occur when the depth of insertion is equal to L2. If full depth insertion is equal to L1, then the point of electrical contact will occur on a line equal in length to L1–L2. By using this emboss blade contact in both the rotating and translating modes, it is possible to double the number of input and output connections on a given daughter board/mother board combination. That is, additional connectors could be placed on the end of daughter boards at the end opposite to those previously described; with direct non-rotating contact being established as outlined above.

Figure 6A:
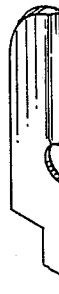
FIGS. 6A, 6B, 6C, 6D and 6E show an alternate form of contacts for use in the present invention.
Figure 6B:
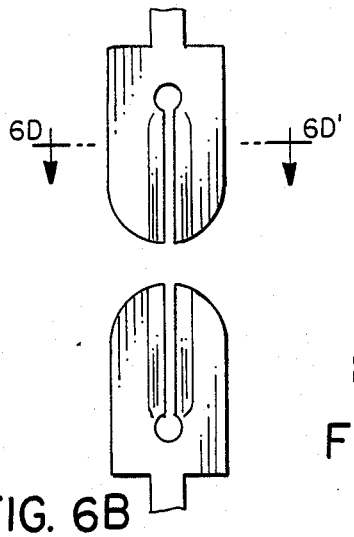
Figure 6C:
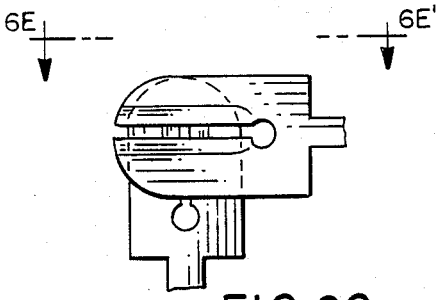
Figure 6D:
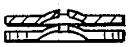
Figure 6E:
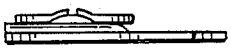

FIG. 6A shows in perspective a split blade contact design wherein a groove passes through the center of the embossed section. Mating occurs as shown initially in FIG. 6B and 6D where the embosses nest within each other and then upon rotation as shown in FIG. 6C contact is established as shown in FIG. 6E.

Figure 7A:
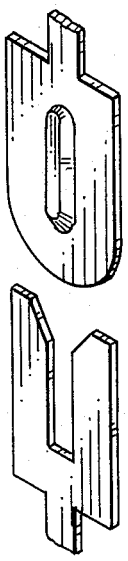
FIGS. 7A, 7B, 7C, 7D and 7E show views of another alternate form of contact for use in the present invention.
Figure 7B:
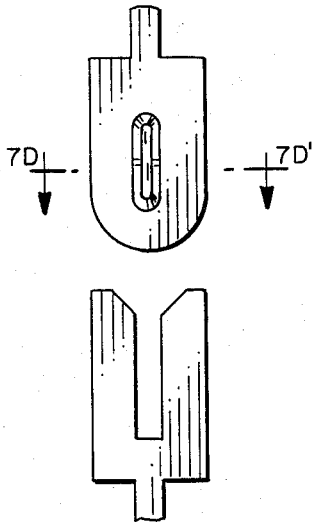
Figure 7C:
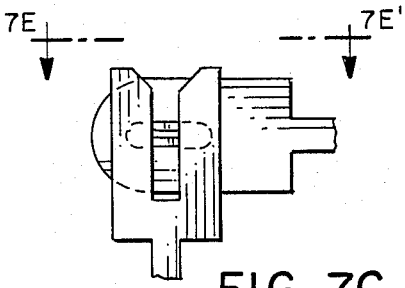
Figure 7D:
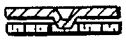
Figure 7E:
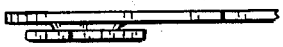

FIG. 7A shows in perspective another contact design, utilizing embossed blade and fork arrangement, wherein the embossed or projection section placed within the fork and falls within the fork as shown in FIG. 7B and falls within the opening of the fork as shown in FIG. 7D. Upon rotation, the raised or embossed portion forces the edges of the fork to deflect and to provide a firm contact as shown in FIG. 7E.

Figure 8A:
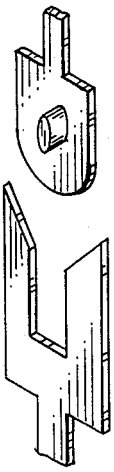
FIGS. 8A, 8B, 8C, 8D and 8E show still another form of contact arrangement for use in the present invention.
Figure 8B:
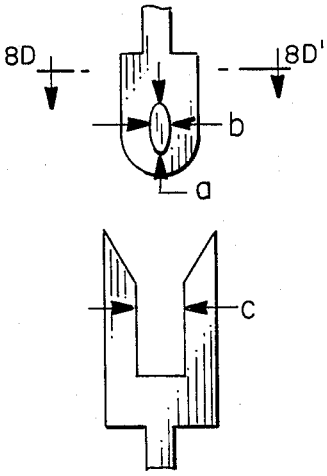
Figure 8C:
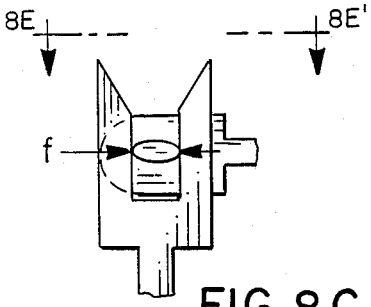
Figure 8D:
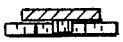
Figure 8E:
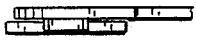

FIG. 8A shows in perspective form a rotating wedge and fork zero insertion force contact design wherein the rotating wedge is inserted within the fork and then on rotation as shown in FIG. 8C establishes contact with the fork edges as shown in FIG. 8E. Such an arrangement has all the attributes of the arrangement shown in FIG. 7, except that the method of generating the contact forces between the wedge and the fork is different. In the arrangement shown in FIG. 8A, the wedge is shaped like an elipse where dimension a, as may be seen in FIG. 8B, is larger than dimension b. The width of the slot c is larger than b and smaller than a. During engagement dimension b being smaller than dimension c, permits zero insertion force operation. When the two are rotated 90 degrees to each other, as can be seen in FIG. 8C, the wedge is caused to spread the tines of the fork due to the interference created by dimension a of the wedge and dimension c of the fork. Two points of contact having a force f are created on the inside surface of the fork as shown in detail in FIG. 8C and also as may be seen in the side view taken along the section lines 8E and 8F, as shown in FIG. 8E.

Figure 9A:
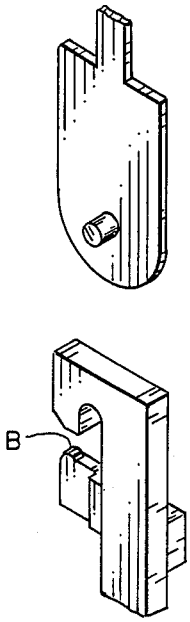
FIGS. 9A, 9B, 9C and 9D show yet another alternate form of contact arrangement for use in the present invention.
Figure 9B:
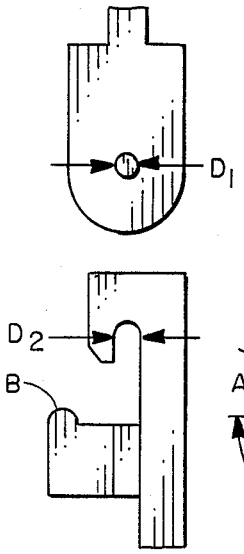
Figure 9C:
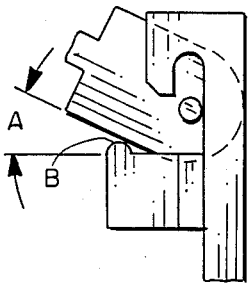
Figure 9D:
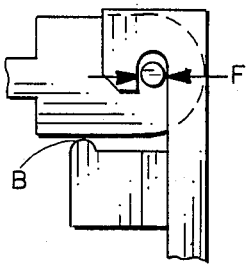

FIG. 9A shows in perspective a levered wedge and fork arrangement of zero force contact design. Rotation is required to actuate the contacts but the angle of rotation is much less than 90 degrees, the pivot point no longer at the point of contact as it was in the previously described designs. In this case, the wedge in the upper portion appears as a cylinder having a diameter equal to d1. The lower portion, or fork, has a slot width, as may be seen in FIG. 9B, equal to d2. Diameter of d1 is greater than diameter d2 by a prescribed amount. When the wedge and fork assembly are engaged, as shown in FIG. 9C, and rotated through an angle about the pivot point, as can be seen in FIG. 9D, the wedge is forced into the fork slot with an interference fit. It is this interference fit that generates the necessary contact force F against contact point B.

Figure 10A:
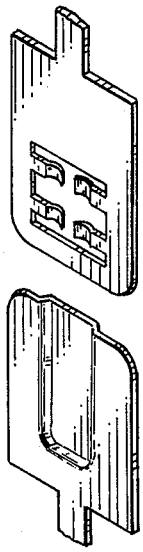
FIGS. 10A, 10B, 10C, 10D and 10E show a final alternate form of contact arrangement for use in the present invention.
Figure 10B:
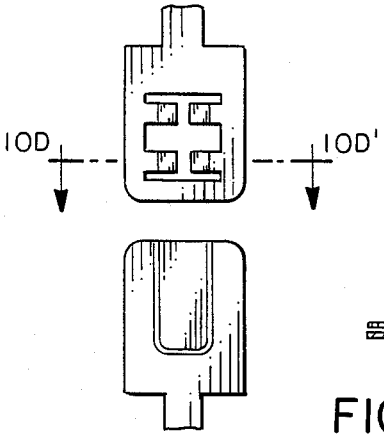
Figure 10C:
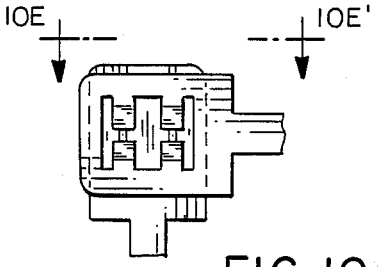
Figure 10D:
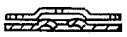
Figure 10E:
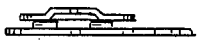

A final contact arrangement is shown in perspective form in FIG. 10A in which a narrow slot effectively is placed through the center of embossed blade contacts, as may be seen in FIG. 10A and 10B. This so-called bifurcated arrangement increase the probability of maintaining electrical contact in an environment containing insulating particulate matter. In this case, both of the mating contacts are bifurcated, the result is quadruplicated electrical points of contact wherein nomal bifurcated contacts result in only two points of contact rather than four. Very few contact systems arrange for four points of contact because of the high cost normally associated therewith. In the present arrangement the embossed blade system provides the necessary four points of electrical contact at little or no extra cost.

As noted above, while the unique rotating contact zero insertion force connector of the present design can employ any of the contact arrangements set forth above, that shown FIGS. 5A, 5B, 5C is preferred.

While a number of embodiments of the present invention are shown, it will be obvious to those skilled in the art that numerous modifications can be made without departing from the spirit of the present invention which shall be limited only by the scope of the claims appended hereto.

What is claimed is:

1. A connector assembly for establishing at least one electrical connection between first and second coplanarly located printed wiring boards, said assembly comprising: at least a first contact including a male portion, said male portion positioned perpendicular to the plane of said first printed wiring board and said first contact mounted on said first printed wiring board;

at least one second contact including a female portion, said female portion positioned parallel to the plane of said second printed wiring board and said second contact mounted on said second printed wiring board;

said female portion sized to receive said first contact male portion with zero insertion force when said printed wiring boards are oriented perpendicularly to each other;

a plurality of horizontally oriented pivot pins located on said first printed wiring card;

a plurality of pivot slots located on said second printed wiring card;

each of said slots adapted to receive a different one of said pivot pins in response to said second printed wiring card being directed in a direction perpendicularly to said first printed wiring board until said slots engage said pivot pins;

after said engagement of said pins in said slots, said second card rotated 90 degrees about said pivot pins from said vertical position to a position parallel to and over said first printed wiring card;

whereby said male portion of said first contact is forced into electrical contact with said female portion of said second contact.

2. A connector assembly as claimed in claim 1 wherein:

said first contact on said first printed wiring board is electrically connected to printed wiring on said first printed wiring board.

3. A connector assembly as claimed in claim 1 wherein:

said contact on said second printed wiring board is an electrical connection with printed wiring circuitry on said second printed wiring board.

4. A connector assembly as claimed in claim 1 wherein:

said first contact and said pivot pins are all located in a common base portion affixed to said first printed wiring board.

5. A connector assembly as claimed in claim 3 wherein:

said common assembly comprises a u-shaped member, including a base portion and two upright sections;

said first contact included in said base portion and said pivot pins each included in one of said upright portions.

6. A connector assembly as claimed in claim 1 wherein:

said first printed wiring board further includes printed wiring board engagement means adapted to receive a portion of said second printed wiring board and maintain said second printed wiring board in a coplanar relationship with said first printed wiring board after said second printed wiring board is rotated 90 degrees about said pivot pins.

7. A connector assembly as claimed in claim 1 wherein:

said first and second contacts are both hermaphroditic in nature.

* * * * *